United States Patent [19]

Endou

[11] Patent Number: 4,555,905

[45] Date of Patent: Dec. 3, 1985

[54] METHOD OF AND SYSTEM FOR UTILIZING THERMAL ENERGY ACCUMULATOR

[75] Inventor: Hajime Endou, Tokyo, Japan

[73] Assignee: Mitsui Engineering & Shipbuilding Co., Ltd., Japan

[21] Appl. No.: 713,570

[22] Filed: Mar. 18, 1985

Related U.S. Application Data

[63] Continuation of Ser. No. 461,018, Jan. 26, 1983, abandoned.

[51] Int. Cl.[4] ..... F01K 3/00

[52] U.S. Cl. ..... 60/659; 60/715

[58] Field of Search ..... 60/659, 715

[56] References Cited

U.S. PATENT DOCUMENTS

| | | | |
|---|---|---|---|
| 3,962,873 | 6/1976 | Davis | 60/641.8 |
| 4,063,417 | 12/1977 | Shields | 60/715 X |
| 4,089,744 | 5/1978 | Cahn | 60/676 X |
| 4,110,987 | 9/1978 | Cahn et al. | 60/652 |
| 4,130,992 | 12/1978 | Bitterlich et al. | 60/652 |
| 4,164,848 | 8/1979 | Gilli et al. | 60/652 |
| 4,291,537 | 9/1981 | Oplatka | 60/652 |

*Primary Examiner*—Allen M. Ostrager

*Attorney, Agent, or Firm*—Charles W. Helzer

[57] ABSTRACT

A method and system is described which employs a thermal energy accumulator in which a thermal energy fluid and hot water coexist with each other. Hot water is taken out of the accumulator and supplied as thermal energy to an energy utilization compound arrangement of a total flow turbine and a steam turbine driving an electric power generator. The thermal energy fluid may be in the form of saturated steam, for example.

4 Claims, 2 Drawing Figures

METHOD OF AND SYSTEM FOR UTILIZING THERMAL ENERGY ACCUMULATOR

This application is a continuation of application Ser. No. 461,018, filed Jan. 26, 1983, now abandoned.

BACKGROUND OF THE INVENTION

The present invention relates to a method of and improved system for utilizing a steam accumulator for storing thermal energy.

A power generating unit in a power plant is required to meet the varying power demand placed on the power plant and which varies with the large differences between peak load and normal load conditions. It is well known in power plants to connect a steam accumulator between the source of steam and the power generator driven thereby for storing excessive steam from the boiler during a lower load or varying load interval and for discharging the stored steam energy for use in a peak load period.

SUMMARY OF THE INVENTION

It is a major object of the present invention to provide a method of and improved system for utilizing a thermal energy accumulator with a higher efficiency of utilization of thermal energy such as steam than is conventionally attained with known prior art systems.

Another object of the present invention is to provide a method of and improved system for utilizing a thermal energy accumulator, which can simplify the utilization of the accumulator with a load through the removal of variations in pressure and temperature of the output from the accumulator.

According to an embodiment of the present invention, there is provided a method of utilizing a thermal energy accumulator in which thermal energy fluid in the form of steam and hot water coexist together, the method comprising the steps of extracting hot water from the accumulator and supplying the extracted hot water to an energy utilization device.

According to another embodiment of the present invention, there is provided a system for utilizing thermal energy stored in an accumulator in which thermal energy fluid in the form of steam and hot water coexist together, and an energy utilization device connected to the accumulator, the accumulator having an inlet for introducing the thermal energy fluid in the form of steam and an outlet for supplying the hot water to the energy utilization device.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
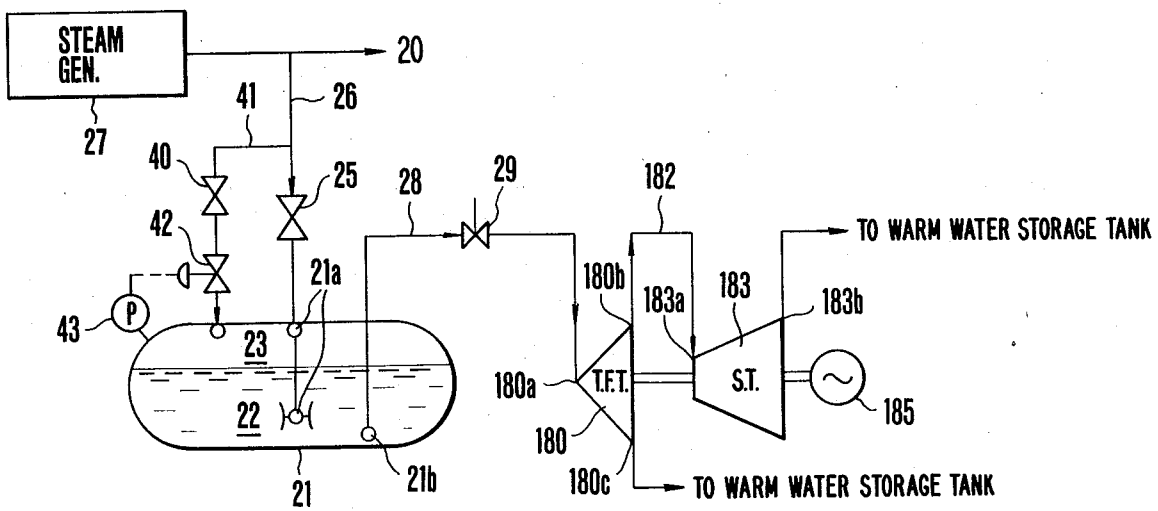
FIG. 1 is a systematic diagram of a system in which hot water is supplied from an accumulator directly to a total-flow power generating unit.

According to the embodiment shown in FIG. 1, a total flow turbine (TFT) 180 is rotated by hot water supplied from an accumulator 21, and a steam turbine (ST) 183 is rotated by steam separated from the hot water by the total flow turbine 180, the turbines being coupled together and driving a power generator 185 for jointly generating electric power. The hot water 22 stored in the accumulator 21 is led to the total flow turbine 180 through a hot water outlet **21*b*, a pipe 28 and a valve 29. The total flow turbine 180 is of known arrangement described in an article authored by Fukuda and appearing in a publication entitled "Heat Management and Public Mischief", Vol. 29, No. 11, 1977, pages 37 to 43, and which is capable of separating the hot water 22 supplied from the accumulator 21 through an inlet 180*a* into medium-temperature warm water and steam. The total flow turbine 180 has a steam outlet 180*b* connected by a pipe 182 to a steam inlet 183*a* of the steam turbine 183, and a medium-temperature warm water outlet 180*c* connected to a warm water storage tank (not shown). Power generator 185 is coupled to the steam turbine 183 which is connected to the total flow turbine 180. The power generator 185 thus effects total flow power generator by means of the steam turbine 183 and the total flow turbine 180 which are interconnected. The steam turbine 183 has a steam outlet 183*b*** connected to the warm water storage tank (not shown) via a condenser (not shown).

The accumulator 21 has an inlet **21*a* which is connected thru a valve 25 and pipe 26 to a steam source 27 serving as a pressure fluid supplementing means for initially charging accumulator 21. Make-up steam is supplied through a valve 40 over a pipe 41 for supplementing the amount of steam and is dependent on the amount of hot water 22 taken out of the hot water outlet 21*b* of the accumulator 21. Pipe 41 has therein a regulator valve 42 in series with valve 40 that is opened and closed in response to detection by a pressure detector 43 of the pressure within the accumulator 21**.

The power generating system of the foregoing construction will operate as follows: Initially, the valve 25 is opened to allow steam to be supplied from the steam source 27 into the accumulator 21 through the steam inlet **21*a*, so that steam heated warm water 22 is stored in the accumulator 21. On demand, the valve 29 is opened to communicate the accumulator 21 with the total flow turbine 180. At this point the valve 40 in the pipe 41 for supplementing steam to the accumulator 21 is opened to provide communication via regulator valve 42 between the steam source 27 and the accumulator 21, and the valve 25 for initially charging the accumulator with hot steam heated water is closed. During the operation thereafter steam is continuously fed through the pipe 41 and valves 40, 42 into the accumulator 21, when hot water 22 is taken out of the accumulator 21 and fed into the total flow turbine 180. The supplied hot water is divided by total flow turbine 180 into medium-temperature warm water and steam, the latter being supplied to the steam turbine 183. Rotation of the steam turbine 183 by the supplied steam and rotation of the total flow turbine 180 jointly cause the power generator 185 to be rotated for total-flow power generation. The steam turbine 186** discharges exhaust steam that is converted by the condenser to water. The warm water separated from the hot water by the total flow turbine 180 is discharged via the warm outlet 180*c* and together with the water from said condenser as a cool water make-up source which is employed when initially storing steam water in the accumulator 21.

When the hot water 22 is discharged from the accumulator 21, the temperature and pressure in the accumuator 21 tend to drop. However, the accumulator 21 is supplied with make-up steam in an amount dependent on the amount of hot water discharged. The amount of make-up steam supplied from the steam source 27 over the pipe 41 is adjusted by the regulator valve 43 with the result that the hot water and the steam in the accumulator 12 will be maintained at constant temperature and pressure at all times. Since the amount of make-up steam supplemented is much smaller than the amount of hot water taken out of the accumulator 21, the accumulator is able to supply hot water and steam substantially under constant conditions at all times. This arrangement increases the efficiency thereof. The power generating system thus designed can be used as an auxiliary peak power generating means.

Figure 2:
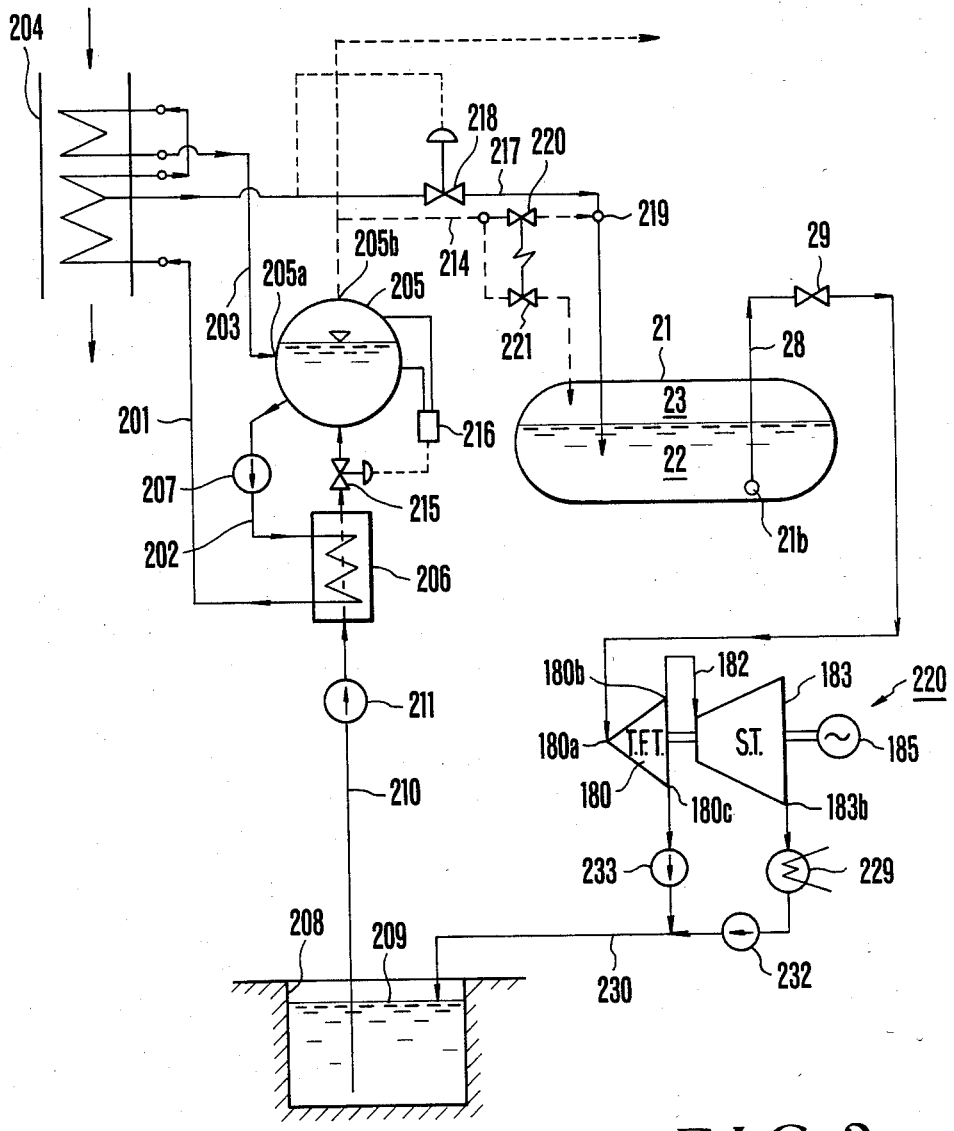
FIG. 2 is a systematic diagram of a system according to a modification in which water discharged from an energy utilization device is utilized as a supplementary fluid medium for a accumulator.

FIG. 2 is illustrative of a hot-water storage power generating system according to a still further embodiment of the invention in which hot water produced by heating waste heat from equipment is stored and supplied to a power generating unit for electric power generation. In FIG. 2, pipes 201, 202, 203 constitute a warm water circulation sub-system having an exhaust gas economizer 204 serving as a warm water heater, a steam drum 205 serving as a steam generator, and a feed water heater 206 with the pipe 202 including a circulation pump 207 for circulating warm water through the warm water circulation sub-system. A warm water storage tank 208 serves to store warm water 209 discharged from a power generating unit 200. The warm water tank 208 and the steam drum 205 are interconnected by a pipe 210 that passes through the feed water heater 206 and has a feed pump 211. The exhaust gas economizer 204 is connected to a waste heat discharger of an apparatus which is located exteriorly of the power generating system. The warm water 209 is heated by exhaust gas in feed water heater 206 into hot water which is led through a hot water inlet into the drum 205. Drum 205 performs the function of separating the supplied hot water into steam and warm water that is circulated via pump 207 to the feed water heater 206. The drum 205 has a steam outlet 205*b* connected through a pipe 214 to an accumulator 21. The feed water heater 206 is capable of preheating the warm water supplied through the pipe 210 to the drum 205. The pipe 210 has, outside of the feed water heater 206, a feed water regulator valve 215 for opening and closing the passage through the pipe 210 in response to a detector 216 of the water level in the drum 205.

The accumulator 21 is in the form of a closed cylinder as with the accumulators according to the preceding embodiment, and is coupled by the pipe 214 to the steam outlet 205*b* of steam drum 205 and by a pipe 217 to the circulating hot water of exhaust gas economizer 104. The pipe 217 has a regulator valve 218 for opening and closing the pipe 217 in response to detection of the temperature of the hot water flowing therethrough. The pipe 214 includes a pair of valves 220, 221 which are selectively openable and closable to provide either a steam passage directly leading to the accumulator 21 or a steam passage leading to a mixer 219 in the pipe 217 in which the steam is mixed with hot water and then supplied to the accumulator 21.

Operation of the hot-water storage power generating system thus constructed is as follows: When storing hot water in the accumulator 21, the warm water 209 stored in the warm water storage tank 208 is fed by the feed pump 211 through the pipe 210 to the steam drum 205 and then is circulated by the circulation pump 207 through the pipe 202, the feed water heater 206, the pipe 201, the exhaust gas economizer 204, and the pipe 203 back to drum 205. Since a high-temperature exhaust gas is led from the exterior apparatus into the exhaust gas economizer 204, the circulating warm water is gradually heated by the exhaust gas into hot water. The warm water 209 in the pipe 210 extending through the feed water heater 206 is preheated by the circulating hot water and supplied to the steam drum 205. When the temperature of the hot water reaches a predetermined level, the regulator valve 218 detects the temperature to thereby open the hot water passage through the pipe 217. As a result hot water is supplied into the accumulator 21 while being mixed by the mixer 219 with steam supplied from the steam outlet 205*b* of the steam drum 205 through the pipe 214 on opening of the value 220. Therefore, hot water supplied to the accumulator 21 has temperature adjusted to a preset level. When the valve 29 is opened, the hot water is supplied from the accumulator 21 into the total flow turbine 180 in which the hot water is separated into steam and medium-temperature warm water. The steam is supplied through the pipe 182 to the steam turbine 183, whereas the medium-temperature warm water is pressurized by the pump 233 and delivered by pipe 230 back to warm water storage tank 208. The steam turbine 183 is rotated by the supplied steam to rotate the power generator 185 in conjunction with total flow turbine 180 for electric power generation. Exhaust steam from the steam turbine 183 is converted by the condenser 229 into water, which is sent by the pump 232 back to tank 208 via the pipe 230. The water is mixed with the medium-temperature warm water from the total flow turbine 180, and the mixed warm water is stored in the warm water storage tank 208. The supply of the warm water 209 to the steam drum 205 is controlled by the feed water regulator valve 215.

During operation of the power generating system, the temperature and pressure in the accumulator 21 tend to drop as the hot water 22 is taken out of the accumulator 21. However, the accumulator 21 is supplied with steam dependent on the amount of hot water discharged therefrom by closing the valve 220 and opening the valve 221, so that the hot water and steam in the accumulator 21 can always be maintained at constant temperature and pressure. The tendency for the temperture and pressure to drop in the accumulator 21 is occasioned by vaporization to fill the space in the accumulator with steam as the hot water is consumed. Since the temperature and pressure drop is small as compared with that experienced when steam is taken out of the accumulator 21, steam may continuously be supplemented in a relatively small quantity.

Although certain preferred embodiments have been shown and described, it should be understood that many changes and modifications may be made therein without departing from the scope of the appended claims.

What is claimed is:

1. A thermal energy storage type power generating system utilizing hot water, comprising:

a thermal energy accumulator to store hot water;

a total flow turbine driven by hot water supplied from said accumulator;

a steam turbine driven by steam supplied from said total flow turbine;

power generator means for power generation connected to and driven by said total flow turbine and said steam turbine; and a steam supplying device for supplementing make-up amounts of steam required to maintain temperature and pressure of hot water in said accumulator constant at all times.

2. A power generating system according to claim 1 which further includes a boiler for producing hot water and steam, at least a portion of said produced steam being supplementally supplied to said accumulator for make-up purposes.

3. A power generating system according to claim 1 wherein said power generator means comprises a single power generator driven by said total flow turbine and said steam turbine through a common drive shaft.

4. A power generating system according to claim 2 wherein said power generator means comprises a single power generator driven by said total flow turbine and said steam turbine through a common drive shaft.

* * * * *